US005275076A

United States Patent [19]

Greenwalt

[11] Patent Number: 5,275,076

[45] Date of Patent: Jan. 4, 1994

[54] STEEL RULE DIE HAVING IMPROVED RULE HOLDERS

[75] Inventor: Curtis Greenwalt, Bristol, Ind.

[73] Assignee: Atlas Die Inc., Elkhart, Ind.

[21] Appl. No.: 10,494

[22] Filed: Jan. 28, 1993

Related U.S. Application Data

[63] Continuation of Ser. No. 807,491, Dec. 16, 1991, abandoned.

[51] Int. Cl.[5] ..... B26D 7/26

[52] U.S. Cl. ..... 83/698; 83/679; 403/357

[58] Field of Search ..... 83/698, 651, 652, 679; 403/324, 374, 378, 379, 357, 372

[56] References Cited

U.S. PATENT DOCUMENTS

| | | | |
|---|---|---|---|
| 1,179,160 | 4/1916 | Burton | 83/698 X |
| 3,527,123 | 9/1970 | Dovey | 83/698 X |
| 3,835,746 | 9/1974 | Young et al. | 83/698 X |
| 3,863,550 | 2/1975 | Sarka et al. | 93/58.3 |
| 3,941,038 | 3/1976 | Bishop | 83/698 X |
| 4,052,886 | 10/1977 | Buick | 93/58.3 |
| 4,187,753 | 2/1980 | Walde | 83/698 X |
| 4,249,441 | 2/1981 | Sturtz | 83/698 X |
| 5,029,505 | 7/1991 | Holliday | 83/652 |
| 5,146,832 | 9/1992 | Wilson et al. | 83/698 |
| 5,197,367 | 3/1993 | Holliday | 83/698 |

*Primary Examiner*—Richard K. Seidel
*Assistant Examiner*—Kenneth E. Peterson
*Attorney, Agent, or Firm*—Woodard, Emhardt, Naughton, Moriarty & McNett

[57] ABSTRACT

A steel rule die including holders providing a holding force assisting in retaining the die rules in their rule slots. The holders include a plurality of resiliently compressible polyurethane plugs positioned adjacent the rules at desired spaced apart locations in cavities formed in the die base member. The plugs are compressibly received in the cavities and have associated portions thereof extending from the cavities which positively urge against the sides of the rules.

11 Claims, 3 Drawing Sheets

STEEL RULE DIE HAVING IMPROVED RULE HOLDERS

This applicaton is a continuation of application Ser. No. 07/807,491, filed Dec. 16, 1991, now abandoned.

BACKGROUND OF THE INVENTION

1. Field of the Invention

The present invention relates generally to the field of diemaking and particularly dies used to cut and score cardboard, paperboard, and other materials to produce folding carton blanks.

2. Description of the Relevant Art

Steel rule dies have been used for many years to cut and score cardboard, paperboard and certain plastic materials used to produce folding carton blanks. It is conventional to manufacture such dies by cutting slots in a die base and inserting steel rules in the slots which extend above the surface of the die base and thereby perform the cutting and scoring operations on the carton blanks. The slots are generated by jig saws, and more recently, by the use of laser beams.

For many years, the practice used to retain the steel rules within the slots has been to control the width of the slots so that the steel rules are held in place by frictional fit contact with the slot sidewalls. Once in place, a side force is exerted by the slot walls against the rules which serves to positively hold them in position. This arrangement has not been entirely satisfactory however because the die base, which is typically wood, is inherently susceptible to dimensional changes, i.e. expansion, contraction and warping, due to changes in the moisture content of the wood, temperature, and other environmental conditions. These dimensional changes can cause the rules to become loosened in their slots, necessitating unscheduled repairs and machine downtime.

Because of problems such as these, base materials other than wood have been tried, as well as other types of die constructions. U.S. Pat. No. 4,052,886 for example describes a steel rule die having a base which is cavernous to receive a filler material which is poured therein and cured to a semi-rigid state to anchor the rules. This arrangement is disadvantaged in that it requires repouring of the die to resecure any loosened rules and does not provide for any side holding force on the rules to retain them in their slots.

U.S. Pat. No. 3,863,550 discloses a steel rule die having a sandwich type base including two plates between which is poured a thermoplastic or thermosetting resin material capable of being cured to a semi-rigid structure. In addition to being expensive to manufacture, this arrangement does not provide any side force against the rules to retain them inside the rule slots.

U.S. Pat. No. 5,029,505 discloses a holder for holding rules in steel rule dies. The holder comprises a ball/-spring assembly which exerts a side force against the rule which serves to retain the rule in its associated slot. Although this design provides a side force to positively retain the rule in its slot, there are other disadvantages which reduce the desirability of this arrangement. For example, the holders have dimensional limitations owing to the ball/spring/housing assembly which make them difficult or impossible to install in conjunction with rule segments of relatively short length. Further, corrosion can build up on the spring and ball assembly and reduce its effectiveness. During cutting or creasing operations it is not unusual to create samll particles of paper dust which can become lodged in the spring so as to jam the spring mechanism. In addition, the holders can themselves become loose and possibly dislodge from their holding channels as a result of the expansion or contraction of the base material defining the holding channels.

SUMMARY OF THE INVENTION

In one aspect of the present invention there is provided a steel rule die including a base member defining a first Plurality of slots and a second plurality of plug cavities associated with the slots. The plug cavities each have a side opening communicating with an associated one of the slots. A second plurality of rules is received in the slots and a third plurality of resiliently compressible plugs is received in the plug cavities. The plugs are normally compressed within the walls of the cavities and exert a holding force against the rules along the cavity side openings.

In a further aspect of the present invention, the plugs and plug cavities are cylindrically shaped and the plugs substantially fill the cavities.

In yet further aspects of the present invention, the plugs are characterized by a polyurethane construction and may be positioned in aligned pairs of cavities positioned on opposed sides of corresponding rules.

Accordingly, it is an object of the present invention to provide a steel rule die having an improved holder for holding the rules securely in place.

It is a further object of the present invention is to provide an improved rule holder which is positively retained relative to the die base so as to reduce the likelihood of the holder being loosened from the die base.

A yet further object of the present invention is to provide an improved rule holder which is economical in construction, will not corrode, and is easily replaced if necessary.

Related objects and advantages of the present invention will become more apparent from the following figures and detailed description.

DESCRIPTION OF THE PREFERRED EMBODIMENT

Figure 1:
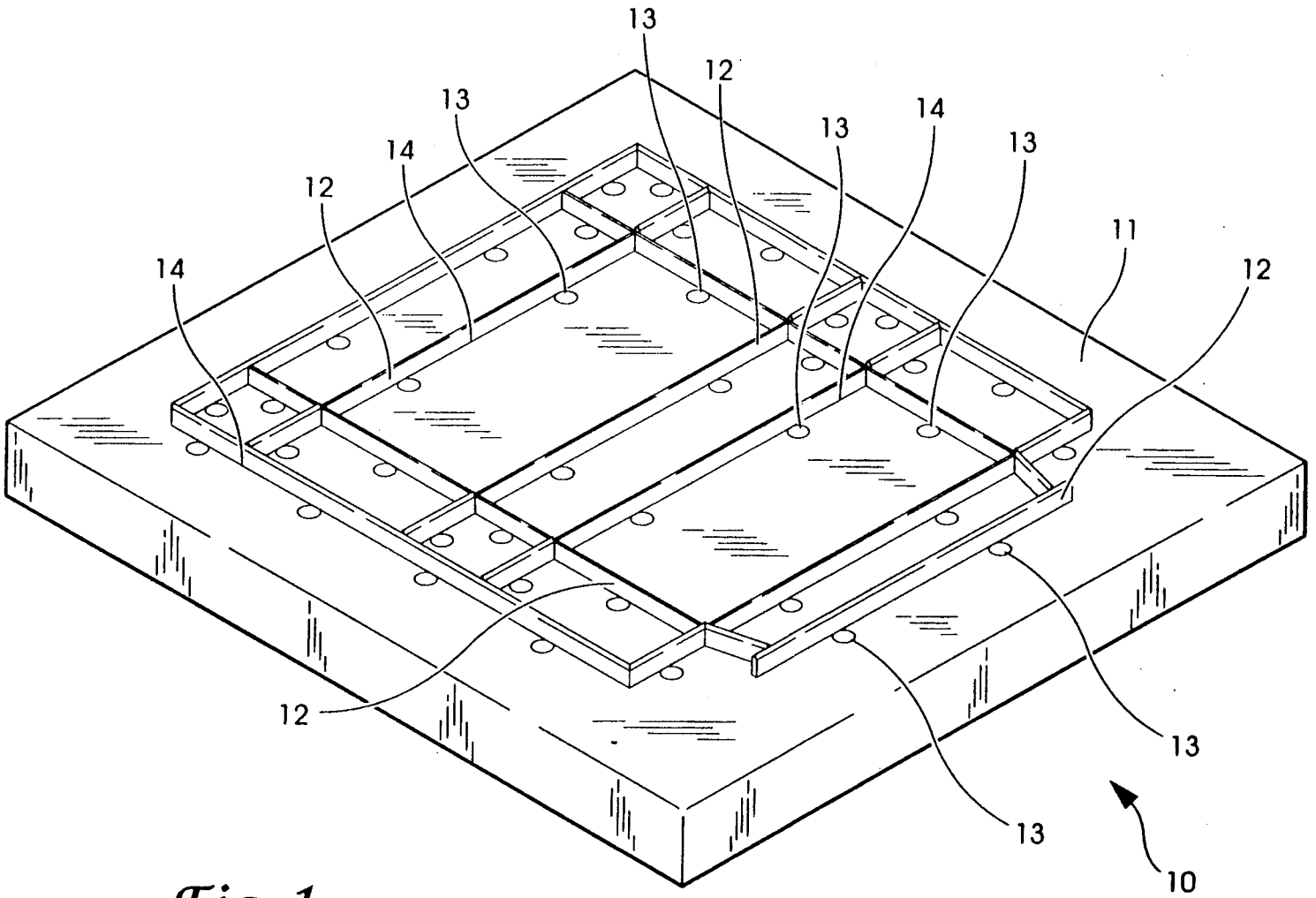
FIG. 1 is a perspective view of a steel rule die of the present invention employing the improved rule holders.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 4:
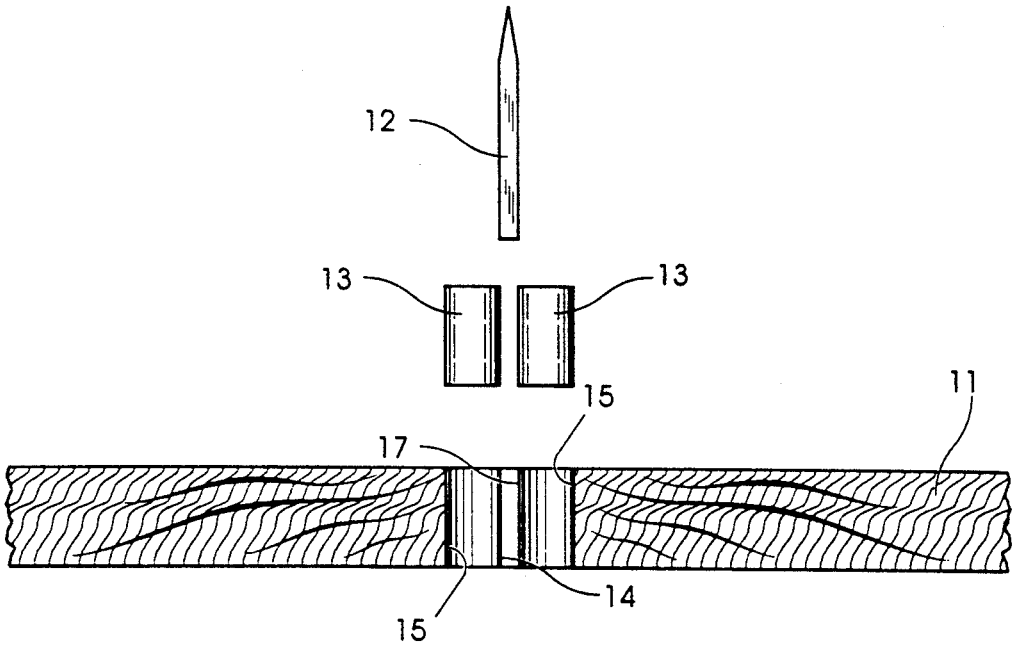
FIG. 4 is a fragmentary cross section view of a portion of a steel rule die base having plug cavities and a slot therein adapted to receive a pair of plugs and a rule.
Figure 5:
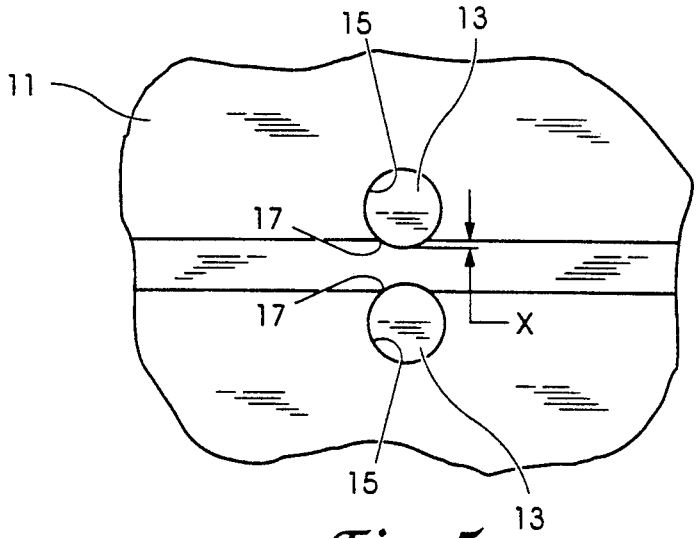
FIG. 5 is a fragmentary top elevational view showing a pair of plugs installed in the die base before a rule is installed therein.

Referring now particularly to FIG. 1, there is shown a steel rule die 10 of the present invention. The die 10 generally includes a base 11, a plurality of rules 12 and a plurality of plugs 13. The base 11 may be formed of any suitable material commonly used for this purpose, such as wood or plastic. The number, size and configuration of the steel rules 12 is illustrative only, it being understood that these will vary for each die according to the specific requirements of the blanks to be generated therefrom. Referring additionally to FIGS. 4 and 5, each of the rules 12 is retained in corresponding slots 14 formed in the base 11. The slots 14 may be formed by any conventional and otherwise suitable method such as by cutting the slots with a jig saw or laser beam, or by conventional routing and milling methods.

As is conventional, the width of the slots is dimensioned relative to the width of the steel rules such that the rules 12 are received in a snug, friction fit inside the corresponding slots 14.

Figure 3:
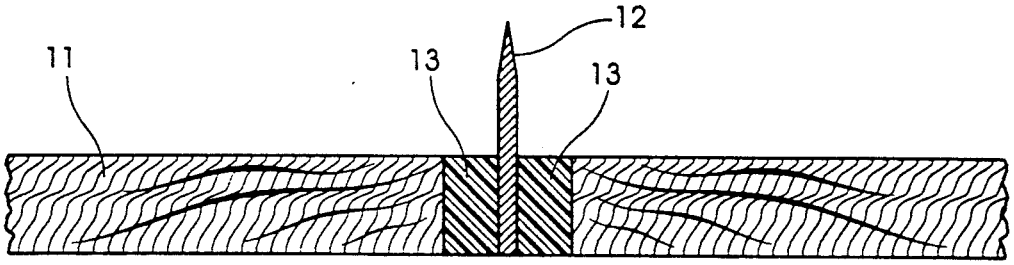
FIG. 3 is a fragmentary cross section view showing a steel rule received in its respective slot with the die base member and retained by the rule holder means of the present invention.

In order to further secure the rules 12 within the slots 13, the base 11 is provided with a plurality of plug cavities 15 receiving therein plugs 13. Each of the plugs 13 are formed of a suitably resilient and compressible material, preferably polyurethane plastic, although other materials, such as for example rubber or vinyl, may also be employed. The plugs 13 and cavities 15 are preferably similarly shaped with the plugs 13 sized slightly larger than the corresponding cavities 15 such that the plugs will be normally compressed by the walls of cavities 15 with the plugs substantially filling the cavities as best seen in FIG. 3. Further, the heighth of the plugs is substantially the same as the thickness of the die base 11.

The plugs 13 are preferably inserted in their locations within slots 14 before installing the rules 12, as this insures that the fragile knife edges of the cutting rules is not damaged during the installation of the plugs.

Preferably, plugs 13 are not permanently fixed within the slots 14 so that they can be removed if required.

In the preferred embodiment, the plugs 13 and cavities 15 are cylindrically shaped, although other configurations may also be employed, it being understood that each of the cavities 15 defines a side opening 17 which communicates with the corresponding adjacent slot 14. As best seen in FIG. 4, the cavities 15, plugs 13 and slots 14 are sized and arranged such that a portion of the plugs 13 would, except for the presence of the rules 12 protrude into the slots 14. The extent of this protrusion is shown by arrows in FIG. 4 and is labelled "x". As a result, the portion of the plugs 13 coextensive with the side openings 17 are compressed against the side portions of rules 12 adjacent thereto and exert a substantial holding force which prevents the rules 12 from becoming disengaged with the slots 14. It has been determined that a 0.002" protrusion of plugs 13 into slots 14 is acceptable for this purpose.

Figure 2:
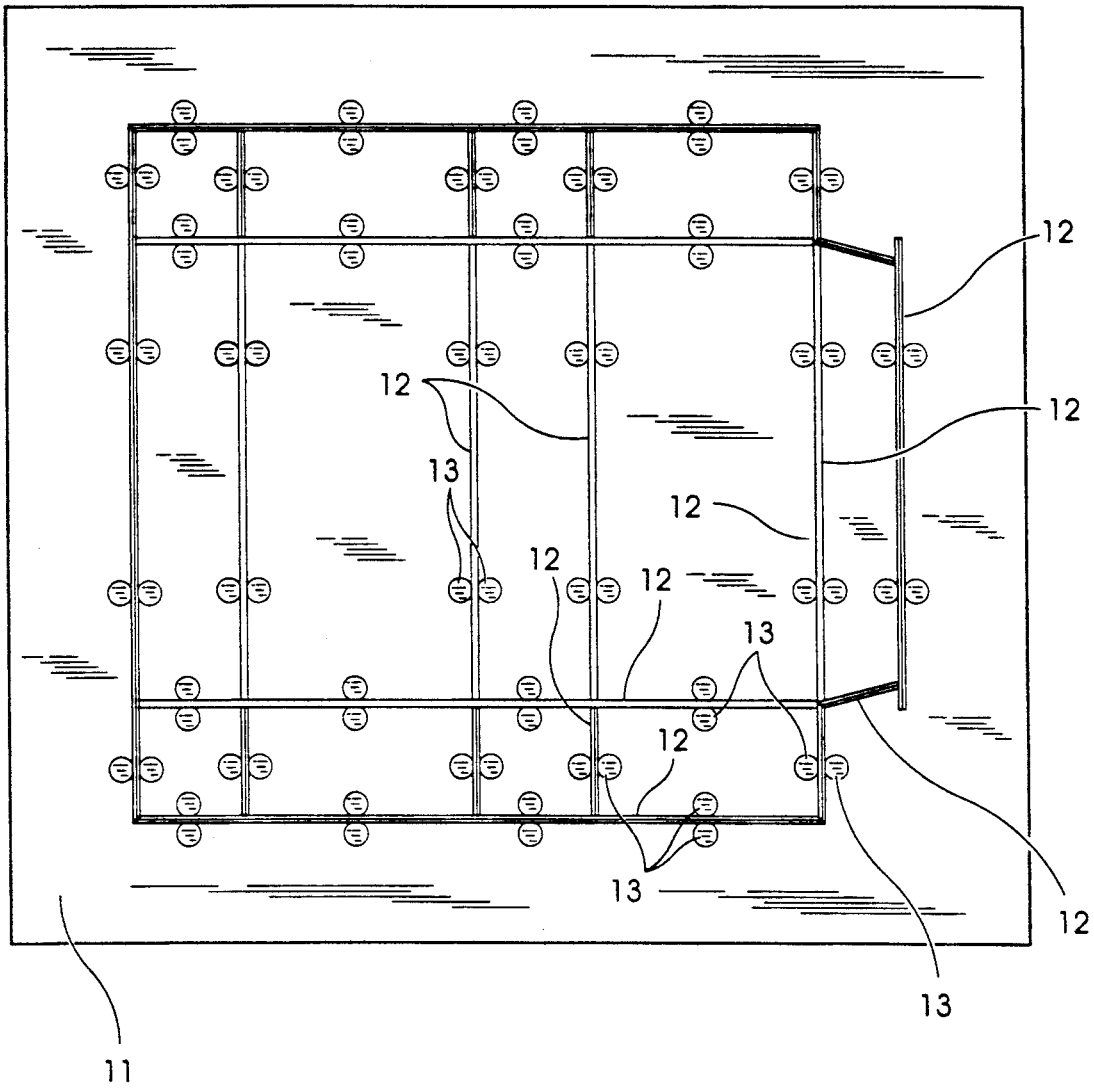
FIG. 2 is a top elevational view of the steel rule die of FIG. 1.

Referring now particularly to FIG. 2, the number and spacing of the plug cavities 15 is a matter of design choice weighing principally manufacturing costs versus the incremental securement benefits provided by additional holders. It has been found that shorter rule segments are more likely to become loosened than longer rule segments, therefore it will usually be desirable to locate the plug cavities 15 adjacent the shorter rule segments. Additional securement benefits have been found to be provided by locating plug cavities 15 in pairs aligned directly opposing one another on opposite sides of a rule 12. This arrangement provides equal pressure on the rules which serves to maintain them in the centers of their corresponding slots 14.

The size of the plugs 13 can also vary depending upon the space available between rules 12. A larger diameter plug may desirably be used to hold wider rule segments, it being appreciated that a steel rule die may be made with rules having widths from one to six points (one point being approximately 0.014") or more.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A steel rule die, comprising:

a wooden base member defining a plurality of slots and a plurality of plug cavities associated with said slots, said plug cavities each having walls defining said plug cavities and a side opening communicating with an associated one of said slots, said walls having opposing sections;

a plurality of rules received in said slots; and a plurality of resiliently compressible plugs received in said plug cavities and conforming substantially to the shape of said plug cavities in frictional contact therewith, said plugs being integrally formed of a non-wooden material possessing expansion and contraction characteristics different from that of said base member, said plugs normally compressed by the walls of said cavities and exerting a retaining force against substantially the entire opposed surface of said walls, including said opposing sections, and a holding force against said rules along said side openings.

2. The steel rule die of claim 1 wherein said plugs are formed of polyurethane plastic.

3. The steel rule die of claim 2 wherein pairs of plugs are received in cavities aligned relative to one another on opposed sides of corresponding rules.

4. The steel rule die of claim 3 wherein said plugs and plug cavities are similarly shaped with said plugs sized larger than said plug cavities.

5. A steel rule die, comprising:

a base member defining a plurality of slots and a plurality of plug cavities associated but offset relative to with said slots, said plug cavities each having walls defining said plug cavities and a side opening communicating with an associated one of said slots;

a plurality of rules received in said slots; and a plurality of resiliently compressible plugs received in said plug cavities, said plugs normally compressed by the walls of said cavities and exerting a retaining force against substantially the entire surface of said walls and a holding force against said rules along said side openings, and wherein said plugs and plug cavities are cylindrically shaped and said plugs substantially fill said cavities.

6. The steel rule die of claim 5 wherein said plugs are formed of polyurethane plastic.

7. The steel rule die of claim 6 wherein pairs of plugs are received in cavities aligned relative to one another on opposed sides of corresponding rules.

8. The steel rule die of claim 6 wherein said base member is wood.

9. A steel rule die, comprising:

a base member;

a plurality of rules received in a friction fit relationship within slots formed in said base member; and a holding means for providing a holding force assisting in retaining said rules in their positions in said slots, said holding means including a plurality of resiliently compressible plugs positioned adjacent said rules at desired spaced apart locations in cavities having walls formed by said base member, said plugs compressibly received in said cavities and having associated portions thereof extending from said cavities and urging against the sides of said rules, said plugs directly urging against substantially the entire surface of the walls of said cavities in frictional engagement therewith, wherein said plugs and cavities are cylindrically shaped and said plugs are integrally formed and substantially fill said cavities.

10. The steel rule die of claim 9 wherein said plugs are formed of polyurethane plastic.

11. The steel rule die of claim 10 wherein pairs of plugs are received in cavities aligned relative to one another on opposed sides of corresponding rules.

* * * * *